US005367123A

United States Patent [19]

Plummer, III et al.

[11] Patent Number: 5,367,123

[45] Date of Patent: Nov. 22, 1994

[54] ELECTRICALLY CONDUCTIVE SHEATH FOR RIBBON CABLE

[75] Inventors: Walter A. Plummer, III, Santa Ana; Vernon L. Shrader, Laguna Hills; Ray W. Alpuche, South Gate, all of Calif.

[73] Assignee: The Zippertubing Co., Los Angeles, Calif.

[21] Appl. No.: 31,820

[22] Filed: Mar. 15, 1993

[51] Int. Cl.[5] ..... H01B 7/34

[52] U.S. Cl. ..... 174/36; 174/35 R; 174/117 F; 174/1; 428/189

[58] Field of Search ..... 174/36, 35 R, 117 F, 174/117 FF; 428/189

[56] References Cited

U.S. PATENT DOCUMENTS

| | | | |
|---|---|---|---|
| 2,960,561 | 11/1960 | Plummer | 174/36 |
| 3,321,572 | 5/1967 | Garner | 174/36 |
| 3,968,321 | 7/1976 | Olszewski et al. | 174/36 |
| 4,327,246 | 4/1982 | Kincaid | 174/36 |
| 4,406,914 | 9/1983 | Kincaid | 174/107 |
| 4,409,427 | 10/1983 | Plummer, III | 174/36 |
| 4,454,379 | 6/1984 | Cleveland et al. | 174/107 |
| 5,030,794 | 7/1991 | Schell et al. | 174/36 |
| 5,084,594 | 1/1992 | Cady et al. | 174/36 |

FOREIGN PATENT DOCUMENTS

| | | | |
|---|---|---|---|
| 0301859 | 2/1989 | European Pat. Off. | 11/10 |

*Primary Examiner*—Morris H. Nimmo

*Attorney, Agent, or Firm*—Christie, Parker & Hale

[57] ABSTRACT

A tubular electrical shielding sheath has inner and outer flexible electrically insulating sheets and an electrically conductive sheet shield sandwiched therebetween. An edge of the conductive shield is folded over the adjacent edge of the inner sheet and brought into electrical contact with the other edge of the shield. One edge of the outer sheet overlaps the other edge of the outer sheet and is adhesively bonded thereto, and one edge of the inner sheet overlaps the other edge of the inner sheet and is adhesively bonded thereto.

25 Claims, 2 Drawing Sheets

Fig. 1
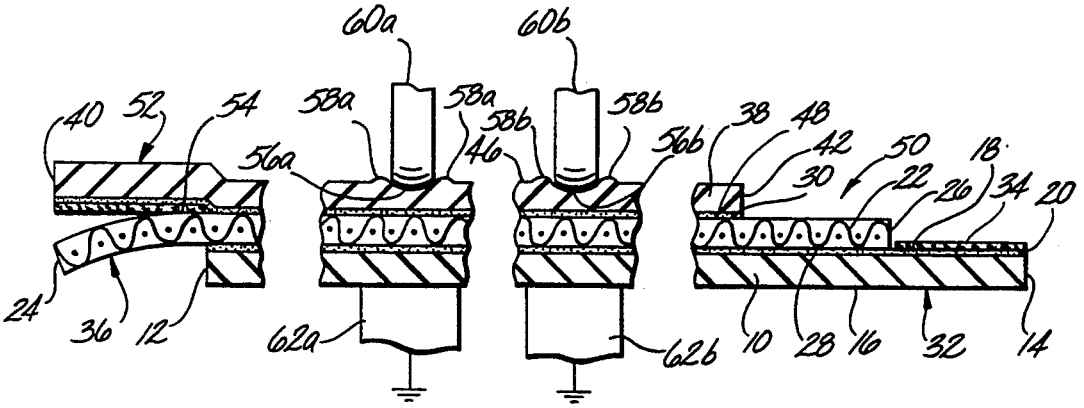
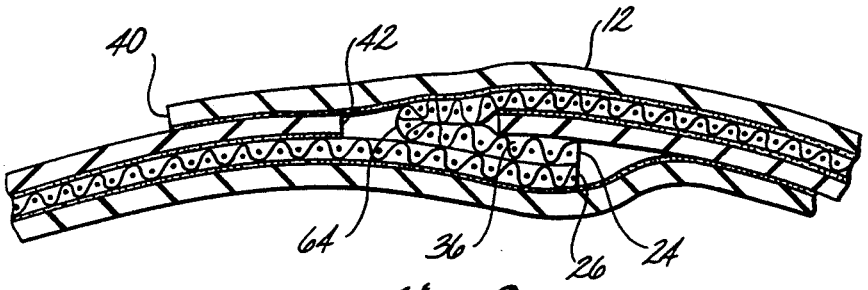
Fig. 2

ELECTRICALLY CONDUCTIVE SHEATH FOR RIBBON CABLE

BACKGROUND OF THE INVENTION

The invention pertains to a shielding sheath for use with electronic cables. More particularly, it pertains to a tubular shielding sheath which may be formed from a flat strip, and is suited for use over a ribbon cable.

Shielding sheaths are commonly used to protect cables from external electromagnetic emissions and/or contain electromagnetic emissions from the cables. A typical sheath comprises a woven metallized fabric conductive shield surrounded by a flexible electrically insulating sheet.

In a prior sheath, the sheet is formed of polyurethane and has an inner surface covered by a layer of pressure-sensitive adhesive. The conductive shield is substantially in contact with and attached to the inner surface of the sheet via the adhesive. The shield is substantially the same width as the sheet, but is slightly laterally offset laterally of the sheath so as to create an overlap section of the shield extending beyond an edge of the sheet and an overlap section of the sheet extending beyond an opposite edge of the shield. A strip of release paper is disposed on the adhesive along the overlap section of the sheet.

To form the insulating sheet and attached shield into a tubular sheath, the release paper is first removed, exposing the adhesive layer. The overlap section of the insulating sheet is then wrapped over the opposite edge of the sheet and secured to the outer surface of the sheet along the opposite edge via the adhesive. Accordingly, the overlap section of the conductive shield is covered by the opposite edge of the shield such that the outer surface of the overlap section is in contact with the inner surface of the shield adjacent the opposite edge. The overlap assures electrical contact and that there is no gap for leakage of radiation. The tubular sheath is flattened by means of a heated roller to crease the edges for receiving a ribbon cable.

When a shielding jacket is made with conductive fabric on the inside and plastic sheet on the outside, there are some remaining problem areas. One significant one is the flammability of the shielding jacket due to the exposed fabric. Attempts have been made to alleviate this by coating the fabric, but they have not been adequate. Attempts have also been made to apply an adhesive tape inside the fabric layer, but these products have not been found to be manufacturable.

There is also appreciable friction between exposed fabric and the cable, which may make it difficult to insert cable in long lengths of shielding sheath.

One prior construction has a strip of metallized fabric extending inside the sheath for overlap to prevent radiation leakage. It is possible when inserting a ribbon cable into the sheath to place it on the wrong side of the strip of fabric, leaving a narrow gap in the shielding for radiation leakage.

A product has been designed with overlapping portions of a conductive fabric arranged in a flattened tubular sheath or jacket such that one edge portion is on one face of a ribbon cable, and the other edge portion of the fabric is on the opposite face of the ribbon cable. When one tries to fabricate such a construction with an insulating sheet on the inside, it is found to be extremely difficult to make.

It would be desirable to alleviate such shortcomings and make a flattened insulating sheath for a ribbon cable with encased electrical shielding which prevents leakage of radiation.

BRIEF SUMMARY OF THE INVENTION

Thus, there is provided in practice of this invention according to a presently preferred embodiment a tubular electrical shielding sheath comprising a sandwich of an inner flexible electrically insulating sheet forming an inside surface of the sheath, an intermediate flexible electrically conductive fabric shield, and an outer flexible electrically insulating sheet forming an outside surface of the sheath. Edge portions of the inner sheet are adhesively bonded together for forming an inner wall of the tube. Edge portions of the outer sheet are adhesively bonded together for forming an outer wall of the tube. The electrically conductive shield is completely enclosed by the inner and outer sheets, and the edges of the shield are overlapped for electrical contact to assure that there is no electrical leakage through the seam.

BRIEF DESCRIPTION OF THE DRAWINGS

These and other features and advantages of the present invention will be appreciated as the same becomes understood by reference to the following detailed description, when considered in connection with the accompanying drawings wherein:

FIG. 1 is a fragmentary cross-sectional view of the edges of an electrically shielded strip for forming a tubular electrical shielding sheath according to principles of the present invention;

FIG. 2 is a partial cross-sectional view of a tubular electrical shielding sheath.

DETAILED DESCRIPTION

Figure 3:
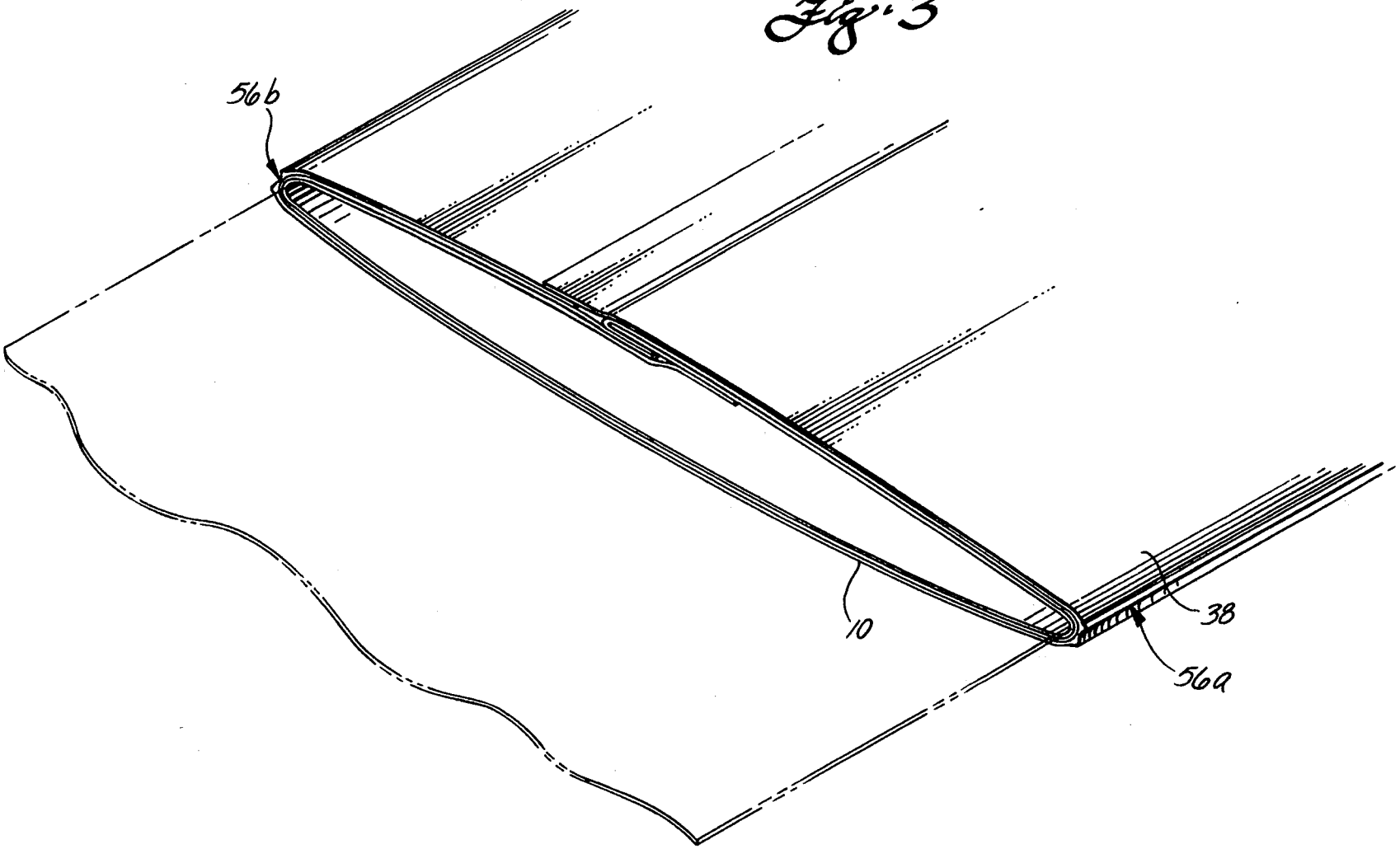
FIG. 3 is an isometric view of a tubular electrical shielding sheath, with a ribbon cable to be shielded shown schematically in phantom.

An electrically shielded sandwich for forming a tubular electrical shielding sheath has a bottom sheet 10 formed of a flexible electrically insulating material such as polyurethane sheet having a thickness of about 170 micrometers. The bottom sheet has left and right edges 12 and 14, respectively, and lower and upper surfaces 16 and 18, respectively. The upper surface 16 is covered with a bottom pressure-sensitive adhesive layer 20 such as an acrylic or polyurethane adhesive with a thickness of about 50 micrometers.

An electrically conductive shield 22 is formed of a metallized synthetic fiber fabric sheet. Such woven fabric is typically nylon, polyester, or other fiber metallized with one or more layers of copper, nickel, copper-nickel alloy or other metal so as to be electrically conductive. Woven synthetic fiber fabric is preferred over woven wire mesh because of its flexibility and fine weave. It is also not subject to fatigue breakage upon repeated flexing. Suitable metallized fabric is available from Monsanto under the product name Flectron. Exemplary material is a plain weave polyester taffeta having a thickness of about 170 micrometers and coated with a layer of oxidation resistant nickel over a layer of copper to provide a resistivity of less than 0.1 ohms per square. Ripstop weave coated fabric may also be used.

The conductive shield has left and right edges 24 and 26, respectively, and lower and upper surfaces 28 and 30, respectively. The lower surface of the shield is substantially in contact with and attached to the upper surface of the bottom sheet via the adhesive layer 20. The right edge 26 of the shield is recessed from the right edge 14 of the bottom sheet, thereby defining an overlap section 32 of the bottom sheet which extends beyond the right edge 26 of the shield and is partially bounded by the right edge 14 of the bottom sheet. A paper release strip 34 temporarily covers the bottom adhesive layer along the overlap section 32.

The left edge 12 of the bottom insulating sheet is recessed from the left edge 24 of the conductive shield, thereby defining an overlap section 36 of the conductive shield extending beyond the left edge of the bottom sheet and partially bounded by the left edge of the shield.

A top sheet 38 is formed of a flexible electrically insulating material, usually of the same raw material as the bottom sheet. The top sheet has left and right edges 40 and 42, respectively, and lower and upper surfaces 44 and 46, respectively. The lower surface 44 is covered with a top adhesive layer 48. The lower surface of the top sheet is substantially in contact with and attached to the upper surface of the conductive shield via the top adhesive layer 48. The right edge 42 of the top sheet is recessed from the right edge 26 of the shield, thereby defining an overlap section 50 of the conductive shield which extends beyond the right edge 42 of the top insulating sheet and is partially bounded by the right edge 26 of the shield.

The left edge 40 of the top sheet extends beyond the left edge 12 of the bottom sheet, thereby defining an overlap section 52 of the top sheet. A paper release strip 54 temporarily covers the top adhesive layer along the overlap section 52. Accordingly, the overlap section 52 is not attached to the upper surface of the conductive shield.

Thus, a sandwich is formed of a top insulating sheet, a conductive shield and a bottom insulating sheet, all secured together by layers of adhesive. Along the right edge of the sandwich there is an outer overlap section 32 of the bottom sheet which has a strip of release paper 34 covering the adhesive and an inner overlap section 50 where the conductive shield is exposed. Along the left edge both an overlap portion 36 of the conductive shield and an overlap portion 52 of the top sheet extend beyond the edge of the bottom sheet. These two extending portions do not adhere to each other since they are separated by a strip of release paper 54.

In a typical embodiment, the sandwich portion of the flat ribbon of material is about 11.5 centimeters wide. The width of the exposed conductive shield at each edge is about one centimeter and the width of each area of exposed adhesive (covered by release paper) is about one centimeter. Such a flat ribbon of material for forming a tubular electrically shielding sheath can have any arbitrary length.

Left and right zones of reduced sheet thickness **56*a* and 56*b*, respectively, are formed along the length of the top sheet by a high-frequency sealer (not shown) having electrodes 60*a* and 60*b* and ground contacts 62*a* and 62*b***. The electrodes, which can be either sliding or rolling element electrodes, are subjected to a voltage of approximately 20,000 volts at a radio frequency, which heats the sandwich and partially melts or softens the top sheet to produce the areas of reduced thickness. As shown, the ground contacts are substantially wider than the electrodes so that no corresponding areas of reduced thickness will be formed in the bottom sheet. The ground contacts may take the form of a single roller or other surface. The sheet materials are preferably laminated as shown, and then passed through the RF sealer for heating the top sheet and forming the zones of reduced thickness. Heated rollers may be used instead of RF heating, if desired.

To form the strip into a tubular sheath, as shown in FIGS. 2 and 3, the sandwich is folded at the zones of reduced thickness so that the top sheet becomes the outside of the tube and the bottom sheet becomes the inside. The layers of adhesive hold the sheets together to form the tube. The edges of the conductive shield overlap each other for electrical shielding without a gap.

First, the left overlap section 36 of the conductive shield is folded back over the left edge of the bottom sheet such that along the overlap section 36, the lower surface of the shield is at least in part in contact with the lower surface of the bottom sheet along the left edge of the bottom sheet. This exposes the release paper strip 54 covering the adhesive on the top sheet. A portion of the bottom surface of the shield along the overlap section may be in contact with itself adjacent a fold 64. Preferably, the sheath is formed with the fold of the conductive shield located as close as possible to the left edge 12 of the bottom sheet.

The release paper strip 34 is removed from the right overlap section 32 of the bottom sheet. The left edge of the sandwich is then wrapped over the right edge such that the bottom and top sheets become inner and outer sheets as the lower and upper surfaces become inner and outer surfaces, respectively.

The upper surface of the conductive shield along exposed section 50 is brought into substantial contact with the upper surface of the shield along the folded overlap section 36 adjacent the left edge of the shield. The upper surface of the bottom sheet along the extending overlap section 32 is brought into substantial contact with and attached to the lower surface of the bottom sheet by the adhesive layer 20. The release strip 54 is removed from the overlap section 52 of the top sheet. The top sheet is then brought into substantial contact with and attached to the outer surface of the top sheet, next to the exposed shield 50, via the adhesive layer 48.

When the sandwich is formed into a tubular sheath, the zones of reduced sheet thickness **56*a* and 56*b*** become elongated fold lines parallel to the sandwich edges which facilitate folding of the sandwich to make the sheath substantially flat for receiving a ribbon cable.

The fold lines for forming a flat tube are preferably located far enough away from each edge of the sandwich that the overlapping connection between the edges of the sandwich is approximately midway between the edges of the flat tube, that is, in about the middle of the flat portion of the tube.

The folded portion of the conductive shield closely engages the exposed portion of the shield along the edge of the bottom or inside sheet. This overlapping of the edges of the shield provides an essentially continuous conductor within the sheath, providing good electrical shielding without leakage at any gaps in the conductor.

In an exemplary embodiment of the tubular sheath, the top and bottom sheets are each formed of a polyurethane film having a thickness of approximately 170 micrometers. The adhesive layers are formed of a pressure-sensitive acrylic adhesive having an thickness of approximately 50 micrometers. The shield is formed of a fabric of metallized synthetic polyester fiber. If the fabric is coated for structural purposes, the coating is preferably on the lower or inner surface so that the folded portion 36 assures good electrical contact. The tubular sheath may be formed in semi-infinite lengths. The width of the tube formed is determined according to the width of ribbon cable which is to be shielded. The zones of reduced thickness are located accordingly.

It will be apparent that the metallized fabric in the protective sheath is completely encased in the flexible protective sheets, both from the inside and the outside of the sheath. This greatly reduces the flammability of the sheath. The layer of flexible insulator on the inside has many additional advantages. The inside surface of the sheath is smooth and cables are readily slipped through it. The cables will not abrade and damage the conductive shield. There is no loose tab of conductive shield inside the sheath, which might be displaced when a cable is inserted, leaving a gap for leakage of radiation. The inside sheet also provides a dielectric spacer between the conductive shield and any cables inside the sheath.

A sheath made according to this invention is tough, flexible, smooth, attractive, strong and abrasion resistant.

To more clearly show the features of the present invention, various elements are shown with exaggerated thickness and the spacings are not drawn to scale. Furthermore, in describing the invention, various indications of direction such as left/right, upper/lower, top/bottom and inner/outer are used. These terms are used to more readily describe the invention when viewed in orientations as are shown in the drawings. Clearly, the invention may be viewed in a variety of orientations, and, additionally, it can be seen that the strip may be formed into a tube by wrapping in either of two directions. Thus, an equivalent structure to that shown in FIGS. 2 and 3 exists as an inside-out counterpart. In other words, what has been described as a bottom sheet is on the outside of the tubular sheath, and the "top sheet" forms the inside surface. Accordingly, such directional language, in the specification and the claims, should not be read as requiring a given orientation or sense of wrap. The only exception, is that the areas of reduced sheet thickness, which serve as means for facilitating folding of the strip, when formed as described in the specification are preferably formed on the true outer or external sheet.

While the preferred embodiment of an electrically conductive sheath for ribbon cable has been described and illustrated herein, many other constructions will be apparent to those skilled in the art. For example, a construction of a shielding sheath or jacket may be made with inner and outer insulating sheets and an intermediate fabric conductor for round cables instead of flattened for ribbon cables. The advantages of low flammability, smooth interior surface, dielectric spacing, etc., are retained. Further, the sheath may be made with an end portion of a different configuration. The outer sheet may be terminated a few centimeters shorter than the inner sheet, leaving a band of the conductive shield exposed at the end of the sheath for making electrical connection and grounding of the conductive shield. It is therefore to be understood that, within the scope of the appended claims, the invention may be practiced otherwise than specifically described.

What is claimed is:

1. An electrically shielded strip for forming a tubular sheath comprising:

top and bottom flexible, electrically insulating sheets, each having upper and lower surfaces and left and right edges; and sandwiched therebetween an electrically conductive sheet shield having upper and lower surfaces and left and right edges, wherein:

the lower surface of the top sheet is substantially in contact with and attached to the upper surface of the conductive shield;

the upper surface of the bottom sheet is substantially in contact with and attached to the lower surface of the conductive shield;

the upper surface of the bottom sheet has an overlap section partially bounded by the right edge of the bottom sheet and extending beyond the right edge of the shield;

the upper surface of the shield has an overlap section partially bounded by the right edge of the shield and extending beyond the right edge of the top sheet;

the lower surface of the conductive shield has an overlap section partially bounded by the left edge of the shield and extending beyond the left edge of the bottom sheet; and the lower surface of the top sheet has an overlap section partially bounded by the left edge of the top sheet and extending beyond the left edge of the bottom sheet and which is not attached to the upper surface of the shield.

2. The electrically shielded strip of claim 1 wherein the electrically conductive sheet shield is formed of a metallized synthetic fiber.

3. The electrically shielded strip of claim 1 further comprising a top adhesive layer on the lower surface of the top sheet along the overlap section thereof and a bottom adhesive layer on the upper surface of the bottom sheet along the overlap section thereof.

4. The electrically shielded strip of claim 3 wherein the top adhesive layer covers the entire lower surface of the top sheet and the bottom adhesive layer covers the entire upper surface of the bottom sheet.

5. The electrically shielded strip of claim 3 further comprising top and bottom release strips covering the portions of the top and bottom adhesive layers in the respective overlap sections.

6. The electrically shielded strip of claim 1 further comprising means for facilitating folding of the strip in two places for forming a substantially flat sheath.

7. The electrically shielded strip of claim 6 wherein the means for facilitating folding of the strip comprise left and right fold zones of reduced sheet thickness extending longitudinally on one of the flexible electrically insulating sheets.

8. The electrically shielded strip of claim 1 wherein the flexible electrically insulating sheets are formed of polyurethane and the adhesive layers are formed of a pressure-sensitive acrylic or polyurethane adhesive.

9. An elongated electrically shielded strip for forming a tubular sheath comprising:

a top electrically insulating sheet having a layer of adhesive on its lower face;

a bottom electrically insulating sheet having a layer of adhesive on its upper face;

an electrically conductive shield layer of metallized fabric sandwiched between the insulating sheets and adhesively bonded thereto;

the sheets and shield layers being offset laterally with respect to each other for forming:

an overlap section of the bottom sheet extending beyond the right edge of the conductive shield;

an overlap section of the conductive shield extending beyond the right edge of the top sheet;

an overlap section of the conductive shield extending beyond of the left edge of the bottom sheet;

an overlap section of the top sheet extending beyond the left edge of the bottom sheet; and a strip of release paper on the adhesive on the overlap section of the top sheet separating the top sheet from the conductive shield.

10. The electrical shielding strip of claim 9 further comprising two parallel, longitudinally extending zones of decreased thickness in one of the sheets for folding the strip for forming a flattened tube.

11. A tubular electrical shielding sheath comprising:

top and bottom flexible electrically insulating sheets, each having upper and lower surfaces and left and right edges; and sandwiched therebetween an electrically conductive shield having upper and lower surfaces and left and right edges;

the lower surface of the top sheet being substantially in contact with and adhesively attached to the upper surface of the shield and the upper surface of the bottom sheet being substantially in contact with and adhesively attached to the lower surface of the shield, and wherein:

the lower surface of the top sheet has an overlap section partially bounded by the left edge of the top sheet and extending beyond the left edge of the bottom sheet and which is substantially in contact with and adhesively attached to the upper surface of the top sheet adjacent the right edge of the top sheet;

the lower surface of the shield has an overlap section partially bounded by the left edge of the shield and substantially in contact with the lower surface of the bottom sheet adjacent the left edge of the bottom sheet;

the upper surface of the shield has an overlap section partially bounded by the right edge of the shield and extending beyond the right edge of the top sheet and substantially in contact with the upper surface of the shield adjacent the left edge of the shield; and the upper surface of the bottom sheet has an overlap section partially bounded by the right edge of the bottom sheet and extending beyond the right edge of the shield and substantially in contact with and adhesively attached to the lower surface of the bottom sheet.

12. The tubular electrical shielding sheath of claim 11 comprising a fold adjacent to the left edge of the conductive shield folding the left overlap section of the shield around the left edge of the bottom sheet for sandwiching the left edge of the shield between the bottom sheet and the right overlap section of the shield.

13. The tubular electrical shielding sheath of claim 11 wherein the bottom sheet forms the inside of the tubular sheath and the top sheet forms the outside of the tubular sheath.

14. The tubular electrical shielding sheath of claim 11 further comprising a pair of parallel zones of reduced thickness in one of the sheets for folding the sheath to a flat cross section.

15. A tubular electrical shielding sheath comprising:

(A) an inner sheet, formed of a flexible electrically insulating material, and having:

a left edge and a right edge;

an inner surface; and an outer surface having a section adjacent the right edge which is substantially in contact with and attached to the inner surface of the inner sheet;

(B) an electrically conductive sheet shield having:

a left edge and a right edge;

an inner surface substantially contacting and adhesively attached to the outer surface of the inner insulating sheet and which, along a section of the shield adjacent the left edge, is folded inwardly for contacting the inner surface of the inner sheet along a section adjacent the right edge of the shield; and an outer surface which, along a section adjacent the left edge is folded inwardly for contacting the outer surface of the shield adjacent its right edge; and (C) an outer sheet, formed of a flexible insulating material, and having:

an outer surface;

an inner surface substantially in contact with and adhesively attached to the outer surface of the shield;

a right edge; and a left edge which overlies the right edge, with the inner surface adjacent the left edge in contact with and adhesively bonded to the outer surface of the outer sheet adjacent its right edge.

16. The sheath of claim 15 wherein the conductive shield comprises a metallized synthetic fiber fabric.

17. The tubular electrical shielding sheath of claim 16 wherein each of the inner and outer electrically insulating sheets comprises polyurethane.

18. A tubular electrical shielding sheath comprising a sandwich of:

an inner flexible electrically insulating sheet forming an inside surface of the sheath, edge portions of the inner sheet being adhesively bonded together for forming an inner wall of the tube;

an intermediate flexible electrically conductive fabric shield; and an outer flexible electrically insulating sheet forming an outside surface of the sheath, edge portions of the outer sheet being adhesively bonded together for forming an outer wall of the tube, the electrically conductive shield being completely enclosed by the inner and outer sheets; and wherein the intermediate conductive shield comprises a folded overlap section along one edge, doubled back on itself and in electrical contact with the opposite edge of the shield.

19. The electrical shielding sheath of claim 18 wherein the sheets and shields are adhesively bonded together.

20. The electrical shielding sheath of claim 18 further comprising a pair of parallel, longitudinally extending fold zones of reduced thickness in the outer sheet for facilitating folding of the sheath into a flattened tube.

21. A tubular electrical shielding sheath comprising a sandwich of:

an inner flexible electrically insulating sheet forming an inside surface of the sheath, edge portions of the inner sheet being adhesively bonded together for forming an inner wall of the tube;

an intermediate flexible electrically conductive fabric shield, the edges of the shield being overlapped for electrical contact; and an outer flexible electrically insulating sheet forming an outside surface of the sheath, edge portions of the outer sheet being adhesively bonded together for forming an outer wall of the tube, the electrically conductive shield being completely enclosed by the inner and outer sheets; and a pair of parallel, longitudinally extending fold zones of reduced thickness in the outer sheet for facilitating folding of the sheath into a flattened tube.

22. The electrical shielding sheath of claim 21 wherein the sheets and shields are adhesively bonded together.

23. A tubular electrical shielding sheath comprising a sandwich of:

an inner flexible electrically insulating sheet forming an inside surface of the sheath, overlapping edge portions of the inner sheet being adhesively bonded together for forming an inner wall of the tube;

an intermediate flexible electrically conductive fabric shield, the edges of the shield being overlapped for electrical contact; and an outer flexible electrically insulating sheet forming an outside surface of the sheath, overlapping edge portions of the outer sheet being adhesively bonded together for forming an outer wall of the tube, the electrically conductive shield being completely enclosed by the inner and outer sheets;

said inner sheet, conductive shield and outer sheet being creased along opposite edges for forming a flattened shield for ribbon cables, the overlapping portion of the conductive shield and the adhesively bonded portions of the inner and outer sheets being approximately midway between the side edges of the flattened sheath.

24. The electrical shielding sheath of claim 23 wherein an edge of the inner sheet extends beyond an edge of the conductive shield for adhesive bonding adjacent to the opposite edge of the inner sheet, and an edge of the outer sheet extends beyond an edge of the conductive sheet for adhesive bonding adjacent to the opposite edge of the outer sheet.

25. The electrical shielding sheath of claim 24 wherein the intermediate conductive shield comprises a folded overlap section along one edge, doubled back on itself and in electrical contact with the opposite edge of the shield.

* * * * *